US006379188B1

(12) United States Patent
Cohen et al.

(10) Patent No.: US 6,379,188 B1
(45) Date of Patent: Apr. 30, 2002

(54) DIFFERENTIAL SIGNAL ELECTRICAL CONNECTORS

(75) Inventors: Thomas S. Cohen, New Boston, NH (US); Philip T. Stokoe, Attleboro; Mark W. Gailus, Somerville, both of MA (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 09/199,126

(22) Filed: Nov. 24, 1998

Related U.S. Application Data

(63) Continuation-in-part of application No. 08/797,537, filed on Feb. 7, 1997, now Pat. No. 5,993,259.

(51) Int. Cl.[7] ..... H01R 13/648

(52) U.S. Cl. ..... 439/608; 439/101; 439/108

(58) Field of Search ..... 439/687–660, 439/676, 941

(56) References Cited

U.S. PATENT DOCUMENTS

| | | | | |
|---|---|---|---|---|
| 4,464,003 A | | 8/1984 | Goodman et al. | |
| 4,596,428 A | | 6/1986 | Tengler | |
| 4,632,476 A | | 12/1986 | Schell | |
| 4,655,515 A | | 4/1987 | Hamsher, Jr. et al. | |
| 4,705,332 A | | 11/1987 | Sadigh-Behzadi | 439/69 |
| 4,806,107 A | | 2/1989 | Arnold et al. | 439/79 |
| 4,820,169 A | | 4/1989 | Weber et al. | 439/65 |
| 4,824,383 A | | 4/1989 | Lemke | 439/108 |
| 4,846,727 A | | 7/1989 | Glover et al. | 439/608 |
| 4,882,554 A | | 11/1989 | Akaba et al. | 333/105 |
| 4,952,172 A | | 8/1990 | Barkus et al. | 439/532 |
| 4,975,069 A | | 12/1990 | Fedder et al. | 439/101 |
| 4,975,084 A | | 12/1990 | Fedder et al. | 439/608 |
| 5,046,960 A | | 9/1991 | Fedder | 439/108 |
| 5,066,236 A | | 11/1991 | Broeksteeg | 439/79 |
| 5,104,341 A | * | 4/1992 | Gilissen et al. | 439/608 |
| 5,117,331 A | | 5/1992 | Gebara | 361/407 |
| 5,224,867 A | | 7/1993 | Ohtuski et al. | 439/108 |
| 5,228,864 A | | 7/1993 | Fusselman et al. | 439/108 |
| 5,403,206 A | | 4/1995 | McNamara et al. | 439/608 |
| 5,429,520 A | | 7/1995 | Morlion et al. | 439/108 |
| 5,433,617 A | | 7/1995 | Morlion et al. | 439/108 |
| 5,433,618 A | | 7/1995 | Morlion et al. | 439/108 |
| 5,496,183 A | | 3/1996 | Soes et al. | 439/79 |
| 5,580,283 A | | 12/1996 | O'Sullivan et al. | 439/686 |
| 5,795,191 A | | 8/1998 | Preputnick et al. | 439/608 |
| 5,851,121 A | * | 12/1998 | Thenaisie et al. | 439/63 |
| 5,913,702 A | * | 6/1999 | Garcin | 439/676 |
| 5,938,479 A | * | 8/1999 | Paulson et al. | 439/676 |
| 6,050,842 A | * | 4/2000 | Ferrill et al. | 439/404 |
| 6,113,418 A | * | 9/2000 | Kjelhahl | 439/405 |

FOREIGN PATENT DOCUMENTS

| | | | |
|---|---|---|---|
| EP | 0 212 764 A2 | 3/1987 | H01R/23/68 |
| EP | 0 442 785 A1 | 8/1991 | B01D/61/14 |
| EP | 0 486 298 A1 | 5/1992 | H01R/23/68 |
| EP | 0 560 550 A2 | 9/1993 | H01R/13/648 |
| EP | 0 486 298 B1 | 1/1996 | H01R/23/68 |
| WO | WO 96/38889 | 12/1996 | H01R/23/68 |

OTHER PUBLICATIONS

Siemens, "SpeedPac: A New Concept for the Next Generation of Transmission Speed", *Backplane Interconnection*, Issue 1/96.

Derman, Glenda, "Speed, density push design xomplexities", *Electronic Engineering Times*, May (1998).

* cited by examiner

*Primary Examiner*—Lincoln Donovan
(74) *Attorney, Agent, or Firm*—Legal Department

(57) ABSTRACT

An electrical connector for transferring a plurality of differential signals between electrical components. The connector is made of modules that have a plurality of pairs of signal conductors with a first signal path and a second signal path. Each signal path has a pair of contact portions, and an interim section extending between the contact portions. For each pair of signal conductors, a first distance between the interim sections is less than a second distance between the pair of signal conductors and any other pair of signal conductors of the plurality. Embodiments are shown that increase routability.

20 Claims, 11 Drawing Sheets

DIFFERENTIAL SIGNAL ELECTRICAL CONNECTORS

RELATED APPLICATIONS

This is a continuation-in-part of U.S. application Ser. No. 08/797,537, filed Feb. 7, 1997, now U.S. Pat. No. 5,993,259 entitled High Speed, High Density Electrical Connector.

BACKGROUND OF THE INVENTION

The invention relates to electrical connectors and, more particularly, to modular electrical connectors that provide signal paths for differential signals between mother boards and daughter boards or other electrical components.

Specialized electrical connectors may be used to connect different components of an electrical system. Typically, such an electrical connector connects a large number of electrical signals between a series of daughter boards to a mother board. The mother and daughter boards are connected at right angles. The electrical connector is typically modular. For example, a flat, planar metallic lead frame contains several signal paths, each of which bends about a right angle within the plane of the metallic lead frame. The signal paths are assembled into an insulated housing that also contains a planar ground plate that provides a ground path and provides isolation between signals. The module is further assembled with other similar modules to form a connector capable of connecting a large number of signals between components in an electrical system.

Typically, the connectors attach to a printed circuit board, e.g., a mother board, daughter board, or back-plane. Conducting traces in the printed circuit board connect to signal pins of the connectors so that signals may be routed between the connectors and through the electrical system. Connectors are also used in other configurations, e.g., for interconnecting printed circuit boards, and for connecting cables to printed circuit boards.

Electronic systems generally have become more functionally complex. By means of an increased number of circuits in the same space, which also operate at increased frequencies. The systems handle more data and require electrical connectors that are electrically capable of carrying these electrical signals. As signal frequencies increase there is a greater possibility of electrical noise being generated by the connector in forms such as reflections, cross-talk and electromagnetic radiation. Therefore, the electrical connectors are designed to control cross-talk between different signal paths, and to control the characteristic impedance of each signal path. In order to reduce signal reflections in a typical module, the characteristic impedance of a signal path is generally determined by the distance between the signal conductor for this path and associated ground conductors, as well as both the cross-sectional dimensions of the signal conductor and the effective dielectric constant of the insulating materials located between these signal and ground conductors.

Cross-talk between distinct signal paths can be controlled by arranging the various signal paths so that they are spaced further from each other and nearer to a shield plate, which is generally the ground plate. Thus, the different signal paths tend to electromagnetically couple more to the ground conductor path, and less with each other. For a given level of cross-talk, the signal paths can be placed closer together when sufficient electromagnetic coupling to the ground conductors is maintained.

An early use of shielding is shown in Japanese patent disclosure 49-6543 by Fujitsu, Ltd. dated Feb. 15, 1974.

U.S. Pat. No. 4,632,476 and U.S. Pat. No. 4,806,107 (both assigned to AT&T Bell Laboratories) show connector designs in which shields are used between columns of signal contacts. These patents describe connectors in which the shields run parallel to the signal contacts through both the daughter board and the back-plane connectors. U.S. Pat. Nos. 5,429,520, 5,429,521, 5,433,617, and 5,433,618 (all assigned to Framatome Connectors International) show a similar arrangement.

Another modular connector system is shown in U.S. Pat. No. 5,066,236 and U.S. Pat. No. 5,496,183 (both assigned to AMP, Inc.), which describe electrical modules having a single column of signal contacts and signal paths arranged in a single plane that parallels the ground plate. In contrast, U.S. Pat. No. 5,795,191, which is incorporated herein by reference, describes an electrical module having electrical signal paths arranged in two parallel planes that each couple to a different ground plate.

It appears that the foregoing electrical connectors are designed primarily with regard to single-ended signals. A single-ended signal is carried on a single signal-conducting path, with the voltage relative to a common ground reference set of conductors being the signal. For this reason, single-ended signal paths are very sensitive to any common-mode noise present on the common reference conductors. We have recognized that this presents a significant limitation on single-ended signal use for systems with growing numbers of higher frequency signal paths.

Further, existing high frequency high density connectors often require patterns and sizes of holes in the attached printed wiring boards (PWB) that limit the width and number of printed circuit signal traces that may be routed through the connector footprint portion of the PWB(s).

We have recognized that, predominantly in a printed circuit backplane, it is highly desirable to have the ability to route on each signal layer multiple traces in various directions between particular patterns, rows, or columns of holes in the connector footprint. We have also recognized that in higher frequency backplane applications, especially for long path lengths, the ability to route wider traces can be used to reduce conductor losses.

We have also recognized that better control of cross-talk can be obtained by designing connectors for differential signals. Differential signals are signals represented by a pair of conducting paths, called a "differential pair". The voltage difference between the conductive paths represents the signal.

Differential pairs are known in such applications as telephone wires and on some high speed printed circuit boards. In general, the two conducting paths of a differential pair are arranged to run near each other. If any other source of electrical noise is electromagnetically coupled to the differential pair, the effect on each conducting path of the pair should be similar. Because the signal on the differential pair is treated as the difference between the voltages on the two conducting paths, a common noise voltage that is coupled to both conducting paths in the differential pair does not affect the signal. This renders a differential pair less sensitive to cross-talk noise, as compared with a single-ended signal path. We have invented an electrical connector well suited for carrying differential pairs.

In addition, it is advantageous to have symmetrical, balanced electrical characteristics for the two conductive paths of a differential pair. Because current connectors have signal paths of different lengths (as shown in FIGS. 2 and 3), the electrical delay of each path is not equal, which can degrade the differential signal quality by inducing skew. It would be highly desirable to have a differential connector that has balanced paths.

Further, it would be desirable to have a differential connector module that is compatible with existing modular connector components. It would also be desirable to have a connector with a circuit board hole pattern that supports multiple wide signal traces and improved routability.

SUMMARY OF THE INVENTION

One aspect of the invention is an electrical connector module for transferring a plurality of differential signals between electrical components. The module has a plurality of pairs of signal conductors with a first signal path and a second signal path. Each signal path has a contact portion at each end of the signal path, and an interim section extending between the contact portions. For each pair of signal conductors, a first distance between the interim sections is less than a second distance between the pair of signal conductors and any other pair of signal conductors of the plurality.

Another aspect of the invention is an electrical connector module for conducting differential signals between electrical components, the connector module having opposing sides terminating along an edge. The module contains a pair of signal conductors optimized for coupling to the differential signal. The conductors are disposed in the module. Each one of the conductors has a contact portion that is laterally spaced along the edge of the module. Surface portions of the pair of conductors pass from the contact portions through the module in a substantially overlaying relationship along a direction extending through the sides of the module.

Each embodiment of the invention may contain one or more of the following advantages. The impedance of each differential signal path is matched. Each signal path of the pair of differential signal conductors is of equal electrical length. The pairs of differential signal paths can be space closer together. The spacing of each pair of differential signal conductors from other pairs reduces cross-talk within the connector. The pair of differential signal conductors can couple to the ground plate to allow other pairs of differential signal conductors to be placed closer to the signal paths without inducing cross-talk. A portion of the shield plate can extend between each of the pairs of differential signal conductors. Noise within each pair of differential signal conductors is reduced. The routing of signal traces is efficient. The grounding contact portions can extend between the contact portions of the signal conductors and allow the signal traces to extend in a direct path through a routing channel. The routing channel can be wide and straight.

DESCRIPTION OF THE PREFERRED EMBODIMENTS

Figure 1:
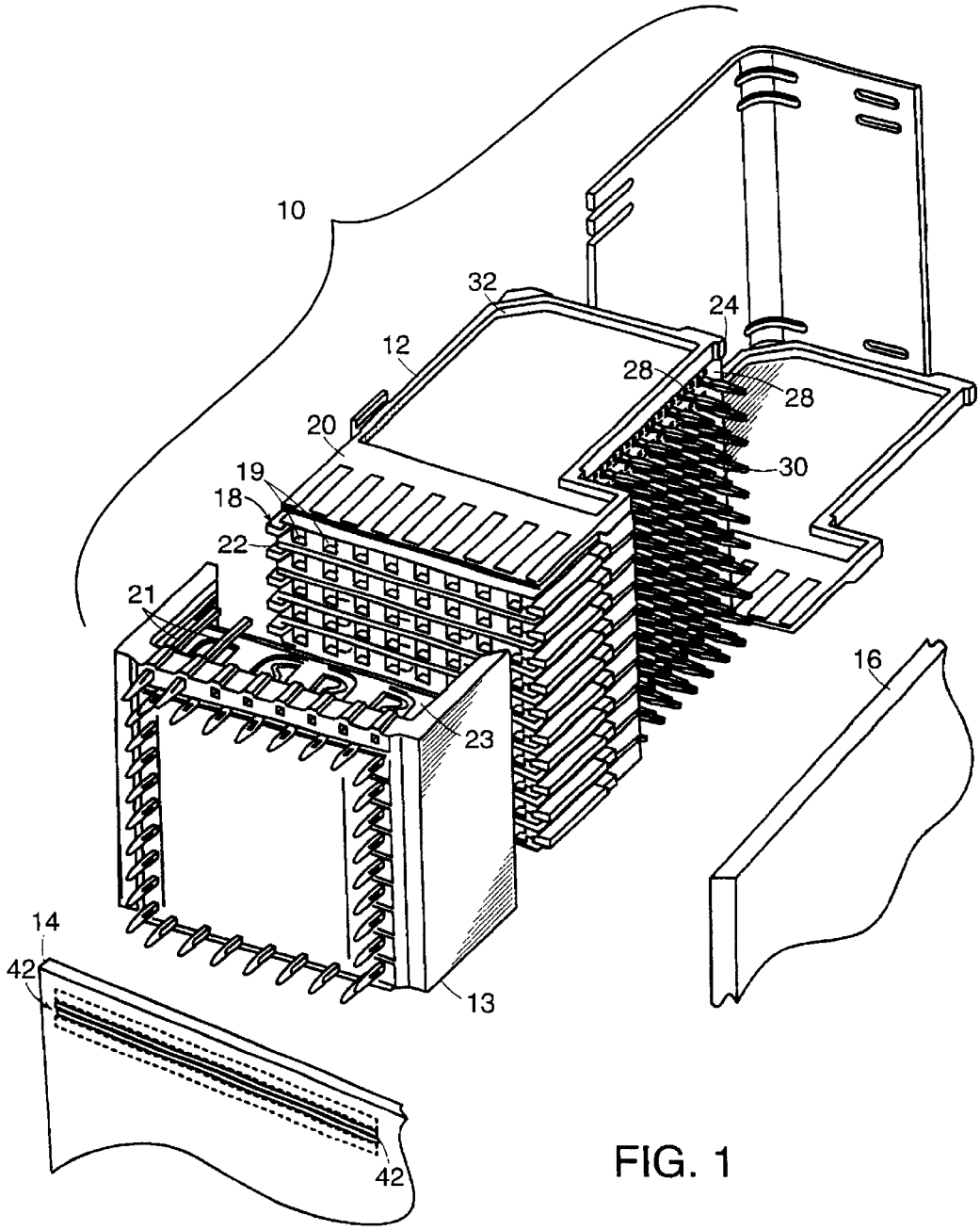
FIG. 1 is a perspective view of a system according to the invention wherein a set of modular connectors are assembled between a mother board and a daughter board.

Referring to FIG. 1, an electrical system 10 includes a modular connector 12 that connects a backplane 14 to a daughter board 16. The connector 12 includes a plurality of connector modules 18 capable of connecting a set of electrical signals, either differential signals, non-differential signals, or both types of signals.

For example, if assembled as described below, the electrical connector module 18 can conduct a pair of differential electrical signals between electrical components of the system 10 such as the mother board 14 and the daughter board 16. Each connector module 18 has opposing sides 20, 22 that are aligned in parallel. The sides 20, 22 each terminate along an edge 24 of the connector module 18. (As shown, edge 24 is a planar surface section 28. However, other configurations are possible.) A set of connecting pins 28 extend from the edge 24. Shields (not shown) may be placed between modules 18.

It should be noted that in a preferred embodiment, the openings 19 in each module 18 are evenly spaced. Likewise, the contact tails 28 are evenly spaced.

Figure 2:
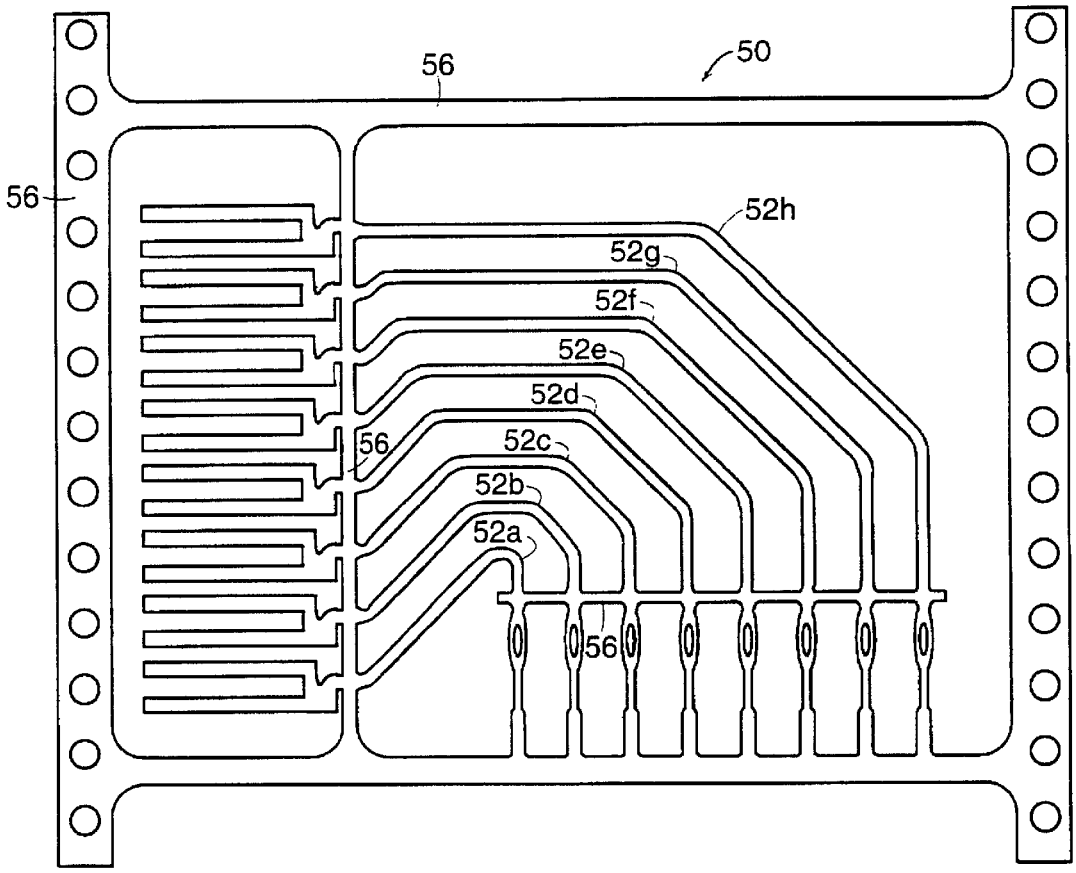
FIG. 2 (PRIOR ART)
FIG. 2 is a schematic view of a prior art signal path metal lead frame that can be used in the assembly of a modular electrical connector wherein the signal paths are equally spaced and are not arranged in differential pairs.

Referring to FIG. 2, a metal lead frame 50 defines eight non-differential signal paths 52*a*–52*h* for use in connector module 18. The metal lead frame 50 is stamped from a thin, metallic, planar member to include carrier strips 56 that support the signal paths 52*a*–52*h* prior to and during assembly of the electrical connector module 18. When the signal paths 52*a*–52*h* are fully integrated into the electrical connector module 18, support sections 56 are disconnected from the signal paths 52*a*–52*h*, and each signal path 52*a*–52*h* is disconnected from the other paths 52*a*–52*h*. U.S. Pat. No. 5,980,321, High Speed, High Density Electrical Connector, filed Feb. 7, 1997, discloses an electrical connector that incorporates the metal lead frame 50. The application U.S.

Pat. No. 5,980,321, which is assigned to Teradyne Inc., is incorporated herein by reference.

Figure 3:
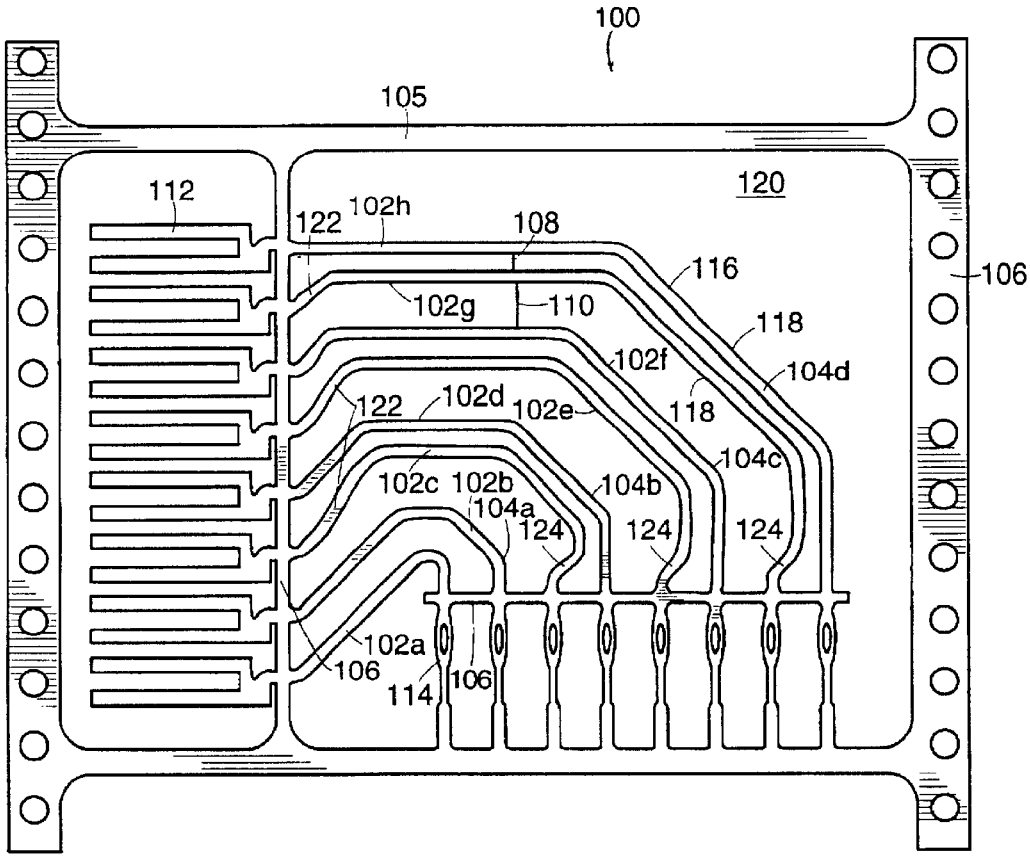
FIG. 3 is a schematic view of a signal path metal lead frame that is used in the construction of a modular connector wherein the signal paths are arranged in pairs of differential signal conductors in a single plane.

Referring to FIG. 3, a similar metal lead frame 100, for use in module 18, defines eight signal paths 102*a*–102*h*. However, the paths 102*a*–102*h* are grouped into four pairs of differential signal conductors 104*a*–104*d*. The metal lead frame 100 is stamped with a thin, metallic, planar member that supports the signal paths 102*a*–102*h* prior to and during assembly of the electrical connector module 18. When the signal paths 102*a*–102*h* are fully integrated into the electrical connector module 18, support sections 106 are disconnected from the signal paths 102*a*–102*h*, and each signal path 102*a*–102*h* is disconnected from the other signal paths 102*a*–102*h* inside the electrical connector module 18.

Each one of the signal paths 102*a*–102*h* includes a pair of contact portions 112, 114, and an interim section 116 between the contact portions. The contact portions 112, 114 are connecting pins that connect the module 18 to the electrical components of the system 10. Contact portions 112 are shown as two parallel members. These members can be folded to form a box contact as in the prior art. The box contact acts as a receptacle for a pin 21 from the backplane. However, separable contact regions of many shapes are known and are not crucial to the invention.

In the present embodiment, the contact portions 112 of the signal paths 102*a*–102*h* are laterally and equidistantly spaced along the edge 118 of the metal lead frame 100. In a preferred embodiment, the spacing is 0.030". Typically, when attached as part of the system 10, the lateral spacing is in a vertical direction. Both the contact portions 112, 114 extend from the housing 32 of the module 18. The external structure of module 18 is identical to other modules which are not specifically designed to conduct differential signals. Therefore, the modules 18 are interchangeable with other modules, and the connector 12 can be configured with different types of modules which allow the connector 18 to conduct both differential and non-differential signals.

The interim sections 116 of each signal path 102*a*–102*h* are aligned in a single plane 120, typically a vertical plane. Therefore, surface portions 118 of each interim section 116 in the pair of conductors 104*a*–104*d* are substantially overlaid in the vertical plane.

Each signal path 102*a*–102*h* is coupled with a second signal path 102*a*–102*h* in pairs of differential signal conductors 104*a*–104*d*. For example, signal paths 102*a*, 102*b* form the pair of differential signal conductors 104*a*; the signal paths 102*c*, 102*d* form the pair of differential signal conductors 104*b*; the signal paths 102*e*, 102*f* form the pair of differential signal conductors 104*c*; the signal paths 102*g*, 102*h* form the pair of differential signal conductors 104*d*. Each signal path 102*a*–102*h* of each pair of differential signal conductors 104*a*–104*d* is coupled to the corresponding signal path 102*a*–102*h* of the pair 104*a*–104*d*. The coupling results because the distance 108 between the interim sections 116 of two adjacent signal paths of differential signal conductors 104*a*–104*d* is small relative to the distance 110 between the interim sections 116 of two adjacent signal paths of adjacent pairs of differential signal conductors 104*a*–104*d*. The interim sections 116 of the pairs of signal conductors 104*a*–104*d* are arranged as close together as possible while maintaining differential impedance. One of the interim sections 116 of each pair 104*a*–104*d* has curved sections 122, 124 that curves toward the other interim section 116 of the pair 104*a*–104*d*. Between the curved sections 122, 124, the pair of conductors 104*a*–104*d* tracks together along most of the interim sections 116.

The curved sections 122, 124 decrease the distance 108 between interim sections 116 of each pair 104*a*–104*d*, increase the distance 110 between adjacent pairs 104*a*–104*d*, and tend to equalize the length of each interim section 116 of the pair 104*a*–104*d*. This configuration improves the signal integrity for differential signals and decreases crosstalk between differential pairs 104*a*–104*d* and reduces signal skew.

Other embodiments are within the scope of the invention.

Figure 4:
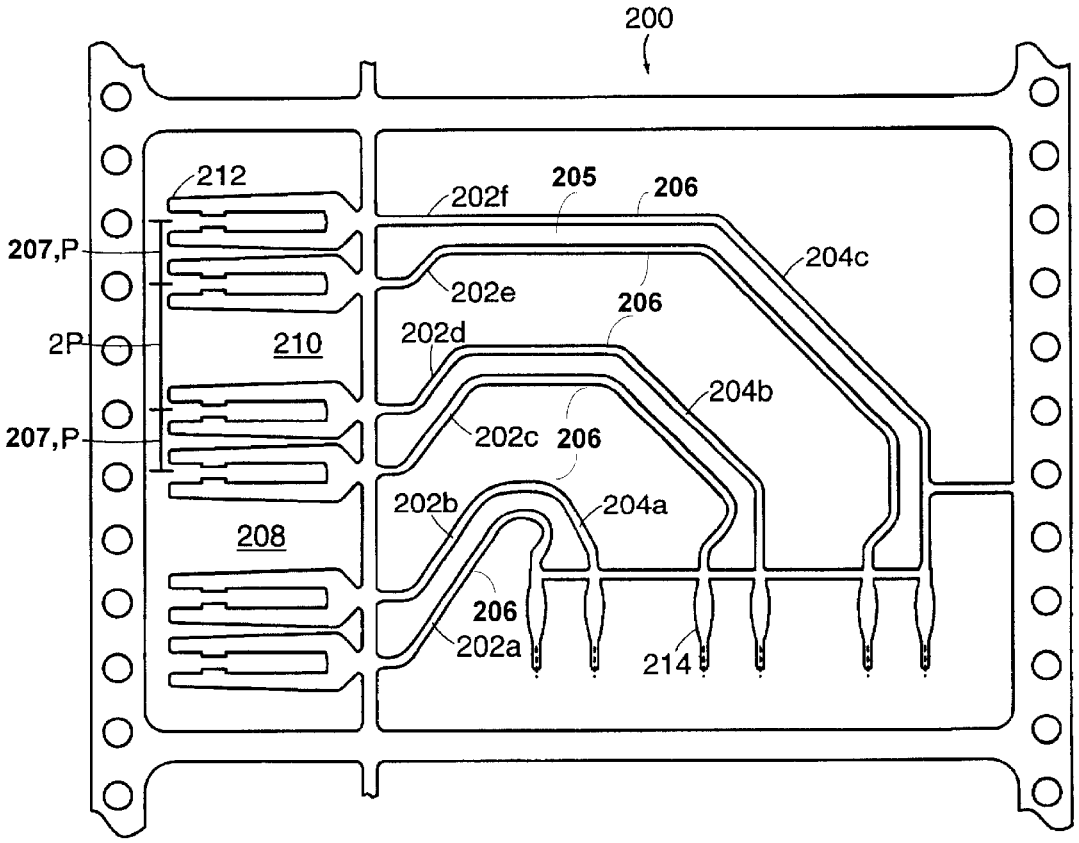
FIG. 4 is a schematic view of still another embodiment of a signal path metal lead frame that is used in the construction of a modular connector wherein the signal paths are arranged in pairs of differential signal conductors in a single plane.

For example, referring to FIG. 4, a metal lead frame 100 includes six rather than eight signal paths 202*a*–202*f*. The signal paths are arranged in three pairs 204*a*–204*c*. In essence, metal lead frame 200 is identical to metal lead frame 100 except that the equivalent of two signal paths 102*c*, 102*f* have been removed. The remaining traces have to be aligned in pairs as before, with the spacing 205 between the interim sections 206 of the signal paths in a pair less than the spacing (P) 207 between the contact portions. Two spaces 208, 210, which are vacated by the signal paths 102*c*, 102*f*, lie between contact portions 214.

Figure 5:
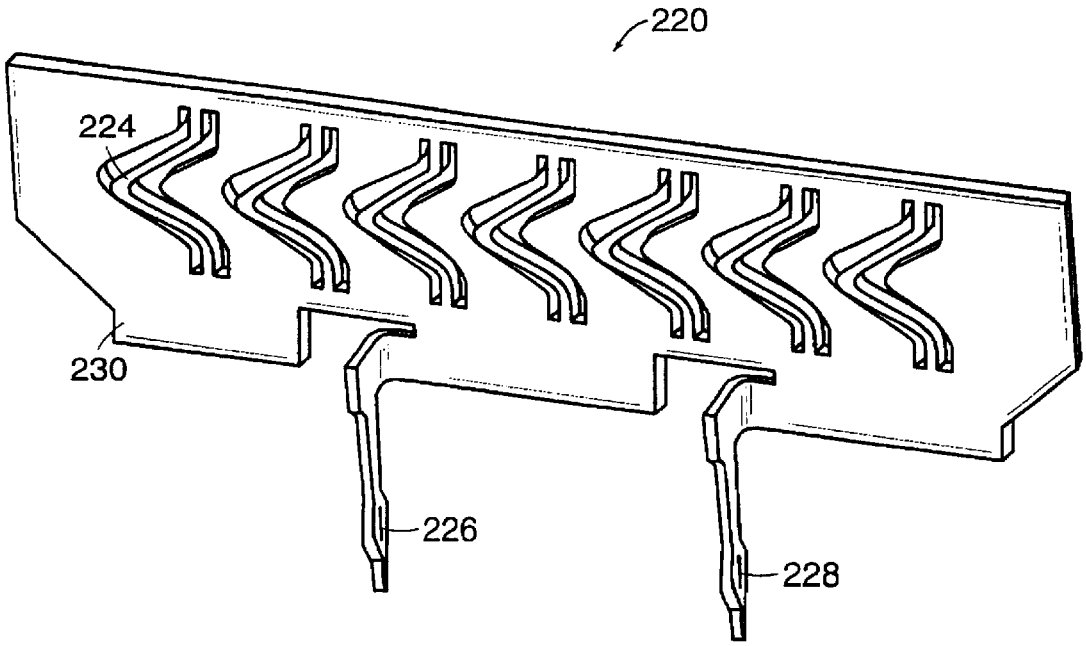
FIG. 5 is a perspective view of a ground plate compatible for use with the signal path metal lead frame of FIG. 4, wherein contact portions of the ground plate are extendable between contact portions of the signal path metal lead frame.

Referring also to FIG. 5, a ground plate 220 contains a main body 230, resilient connecting tabs 224, and contact portions 226, 228. Ground plate 220 is intended to be used in place of ground plate 23 (FIG.1), particularly in conjunction with the embodiment of FIG. 4.

When a connector 12 is fully assembled and mated with connector 13, the ground plate 222 is parallel to the signal paths 202*a*–202*f*. The contact portions 226, 288 are aligned with the contact portions 212 of the signal paths 202*a*–202*f*. The contact portions 226, 228 are each at corresponding right angles to the main body 230 and extend between the contact portions 212 within corresponding spaces 208, 210.

Figure 5A:
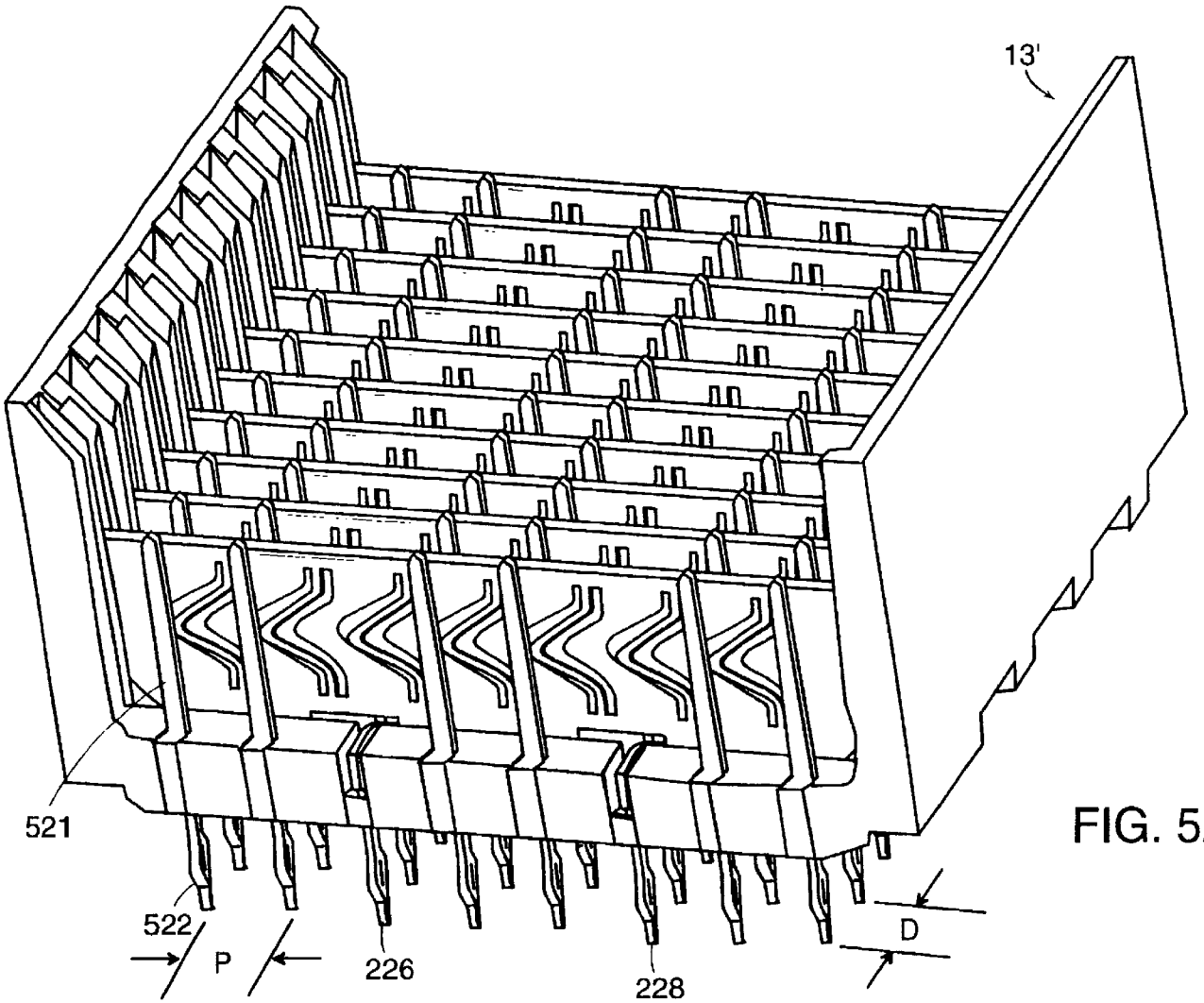
FIG. 5A is a perspective view of a pin header incorporating the ground plate of FIG. 5.

FIG. 5A shows the backplane module 13' including the shield member 220. There are columns of signal pins 521. Each column contains six signal pins 521, to correspond to the six mating contacts 212. There is no signal pin in backplane connector 13' corresponding to spaces 208 and 210 (FIG. 4). Rather, contact portions 226 and 228 are inserted into the spaces that correspond to spaces 208 and 210. As a result, there are eight contact tails in each column—six corresponding to signal pins 521 and two being appending contact tails 226 and 228. The spacing between the contact tails is uniform, illustrated as dimension P in FIG. 5A.

This arrangement of contact tails means that the spacing between adjacent columns is a dimension D. The spacing D is dictated by the spacing between signal pairs 521 in adjacent columns.

By contrast, in backplane connector 13 (FIG. 1), the space between columns of contact tails for signal pins is occupied by contact tails for a shield plate.

When a backplane connector is attached to backplane, a hole must be made for each contact tail. No signal traces can be routed in the backplane near holes. Thus, to space signal traces across a backplane, the traces generally run in the spaces between columns of contact tails. In the embodiment of FIG. 5A, the spacing D represents a wide routing channel for signal traces. Thus, the signal traces can be made wider and therefore have lower loss. The traces can also be made straighter because they do not have to jog around ground holes in the channels between signal contact tails. Straighter traces result in fewer impedance discontinuities, which are undesirable because they create reflections. This feature is particularly beneficial in a system carrying high frequency signals. Alternatively more traces could be routed in each layer, thereby reducing the number of layers and saving cost.

Figure 6:
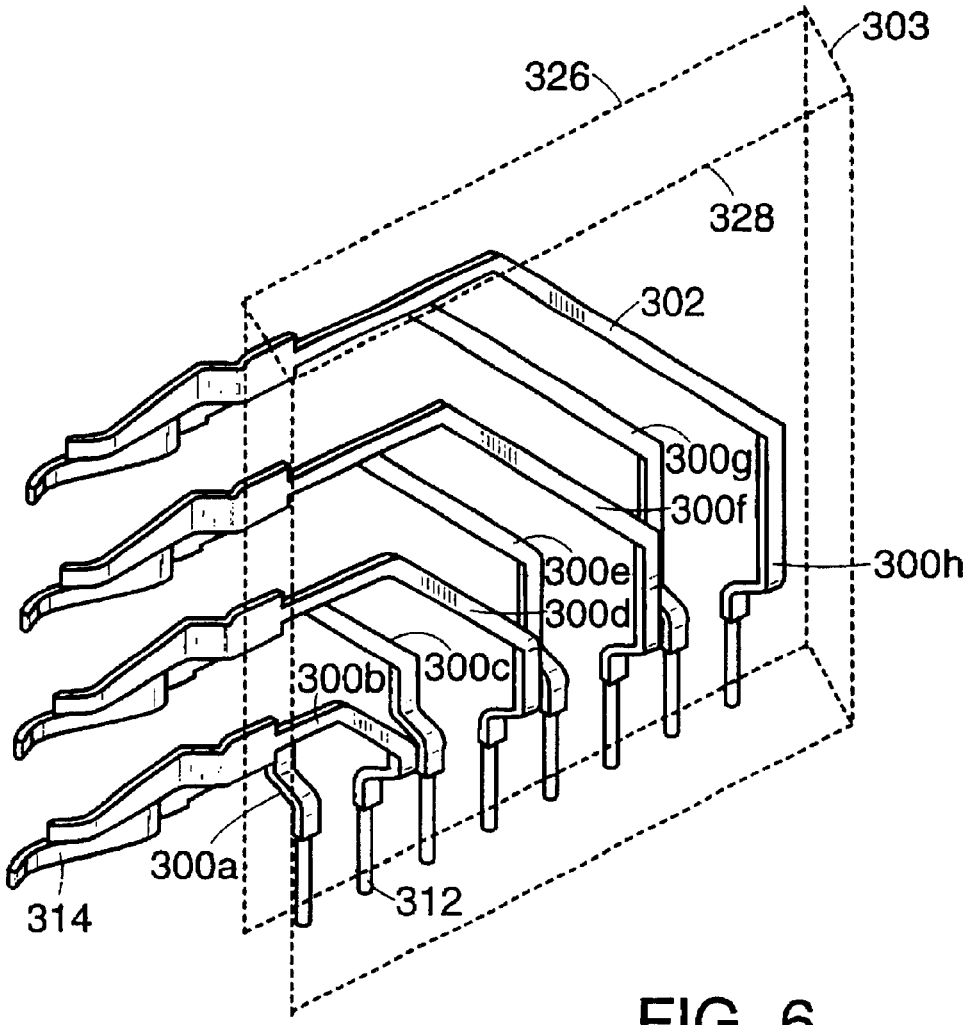
FIG. 6 (PRIOR ART)
FIG. 6 is a perspective view of an arrangement of signal paths according to the prior art wherein the signal paths are arranged in two parallel planes, each signal path in one plane inductively coupling with a first ground plate (not shown) and each signal path in the other plane coupling with a second ground plate (not shown)

Referring to FIG. 6, a set of prior art signal paths 300*a*–300*h* for use in a modular electrical connector have interim sections 302 that are aligned along two different parallel planes 320, 322. Half of the interim sections are aligned along each corresponding plane. Contact portions 314 are aligned in a third central plane. Contact portions 312 lie in separate planes and are aligned with the third central plane. Thus, when fully assembled, each interim section 302 lies closer to a ground plate than to another of signal paths 300*a*–300*h*.

Figure 7:
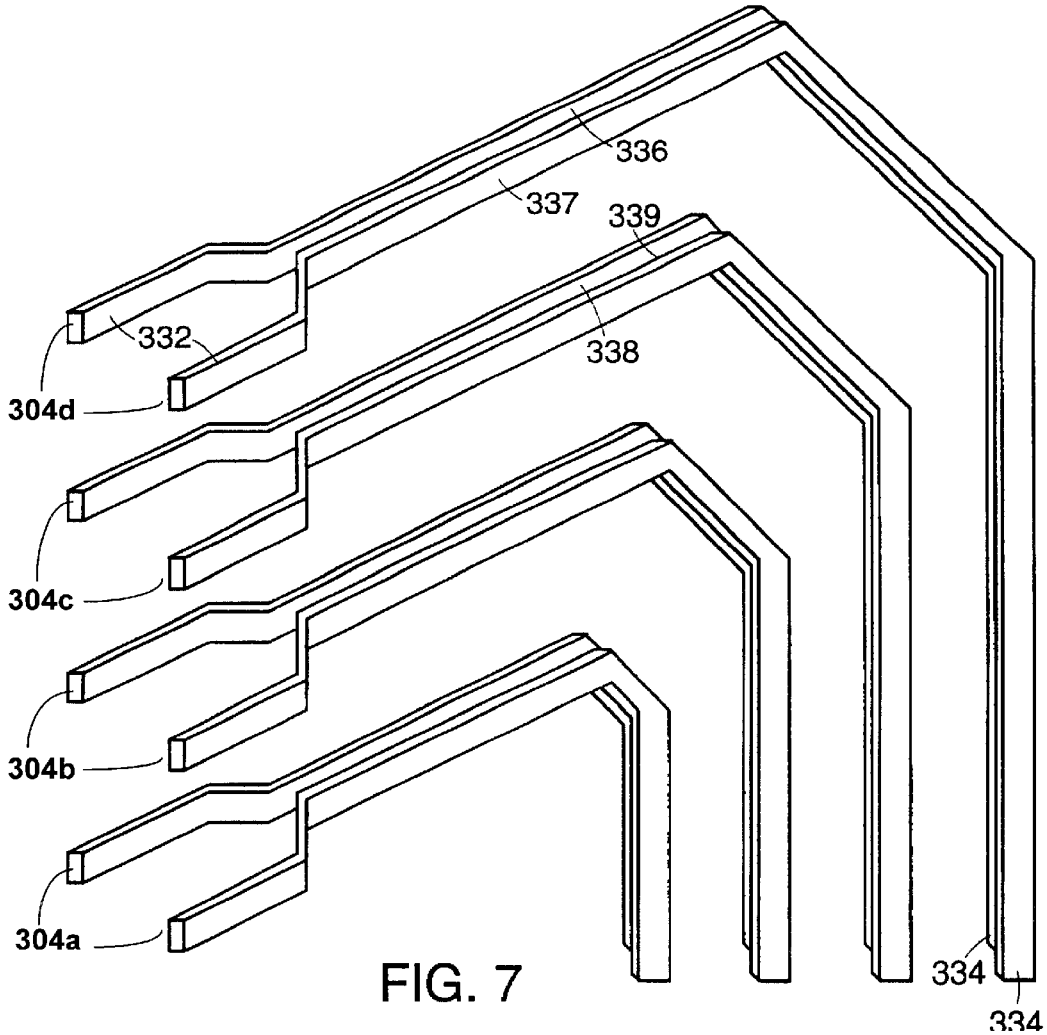
FIG. 7 is a perspective view of another embodiment of signal paths arranged in pair of differential signal conductors, wherein the signal paths are arranged in two parallel planes.

Referring also to FIG. 7, the signal paths of FIG. 6 are adapted to provide a set of differential signal conductors 304*a*–304*d*. Each conductor of the pairs 304*a*–304*d* includes a pair of contact portions 332, 334 and interim sections 336, 337 extending between contact portions 332, 334. Each pair of interim sections 336, 337 has a corresponding surface 338, 339 that overlays the other corresponding surface 338, 339. The surfaces 338, 339 overlay each other in a direction that extends through the sides 326, 328 of an electrical connection module 303, shown in FIG. 6. Thus, relative to the pairs 104*a*–104*d* of FIG. 3 which typically have overlying surfaces 118 in the vertical direction, the pairs 304*a*–304*d* typically have overlying surfaces 338, 339 in the horizontal direction. (The comparison between the pairs 104*a*–104*d* and the pairs 304*a*–304*d* is relative, and the surfaces 338 may overly in directions other than horizontal.)

However, unlike the paths 300*a*–300*h* depicted in FIG. 6, interim section 336 of each pair 304*a*–304*d* lies closer to corresponding interim section 337 of each pair 304*a*–304*d* than to a ground plate or another pair of signal conductors 304*a*–304*d*. Therefore, each pair of conductors 304*a*–304*d* couples to the corresponding conductor of the pair 304*a*–304*d* to reduce noise.

The differential pairs of signal contacts will, preferably be held in an insulative housing, which is not shown. The contacts might be positioned as shown in FIG. 7 and then insulative material could be molded around the interim sections of the contacts. To achieve appropriate positioning of the contact members, a plastic carrier strip might be molded around the contact members in one plane. Then, the contact members in the other plane might be overlaid on the carrier strip. Then, additional insulative material could be molded over the entire subassembly.

An alternative way to form an insulative housing around the contact members in the configuration shown in FIG. 7 would be to mold the housing in two interlocking pieces. One piece would contain the signal contacts in one plane. The other piece would contain the signal contacts in the other plane. The two pieces would then be snapped together to form a module with the signal contacts positioned as in FIG. 7. This manufacturing technique is illustrated in U.S. Pat. No. 5,795,191 (which is hereby incorporated by reference). However, that patent does not recognize the desirability of positioning the interim sections of the signal contacts in the two pieces of the subassembly so that, when the two pieces are assembled, the signal contacts will overlay to create differential pairs.

Figure 9:
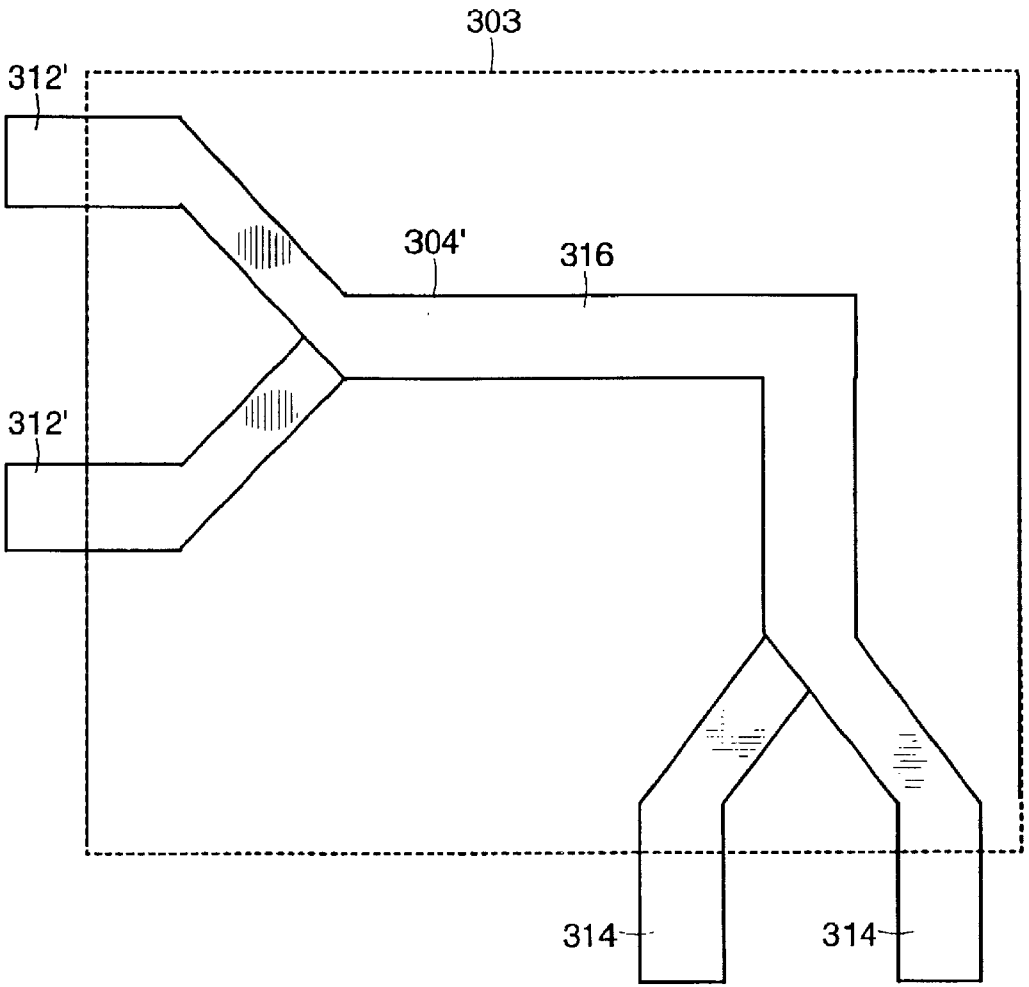
FIG. 9 is a side view of the signal paths of FIG. 8.
Figure 8:
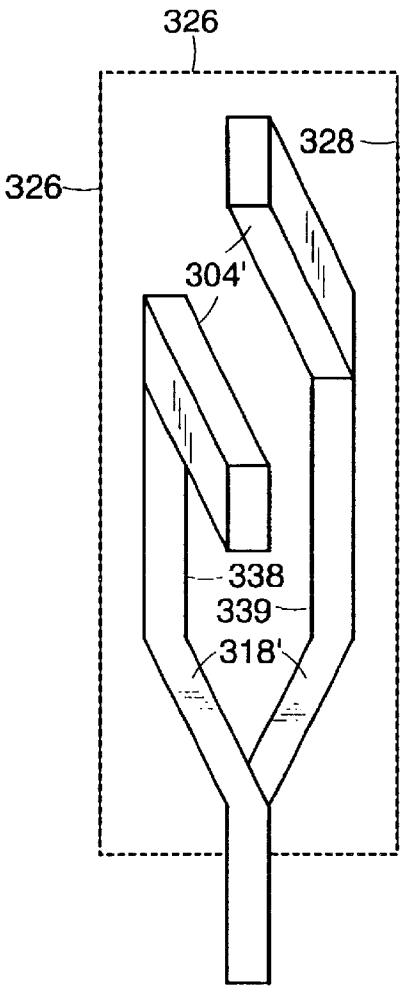
FIG. 8 is a front view of yet another embodiment of signal paths arranged as a pair of differential signal conductors, wherein the signal paths are arranged in two parallel planes.

Referring also to FIGS. 8–9, an alternate arrangement of signal paths includes pairs of signal conductors 304' (here one pair being shown). Like the signal paths 300*a*–300*h* of FIG. 6, each conductor 304' of the pair extends toward the corresponding side 326, 328 of a module 303'. However, unlike the signal paths 300*a*–300*h*, surfaces 318' of the pair of signal conductors 304' are respectively jogged to have overlaying surfaces 338', 339' in a direction that is perpendicular to the sides 326, 328 of the module 303'. Thus, like the pairs of conductors of FIGS. 3, 4 and 7, the distance between conductors 304' is smaller than the distance from the pair of conductors 304' to other similar pairs of conductors. Also, like the contact portions 312 of FIG. 6, the contact portions 312', 314' all lie in a third central plane. In comparison, the contact portions 332 shown in FIG. 7 and contact portions 314 shown in FIG. 6 lie in two distinct planes.

As another alternative, it is not necessary that shield plates be used with the differential connector modules as described above.

Figure 10:
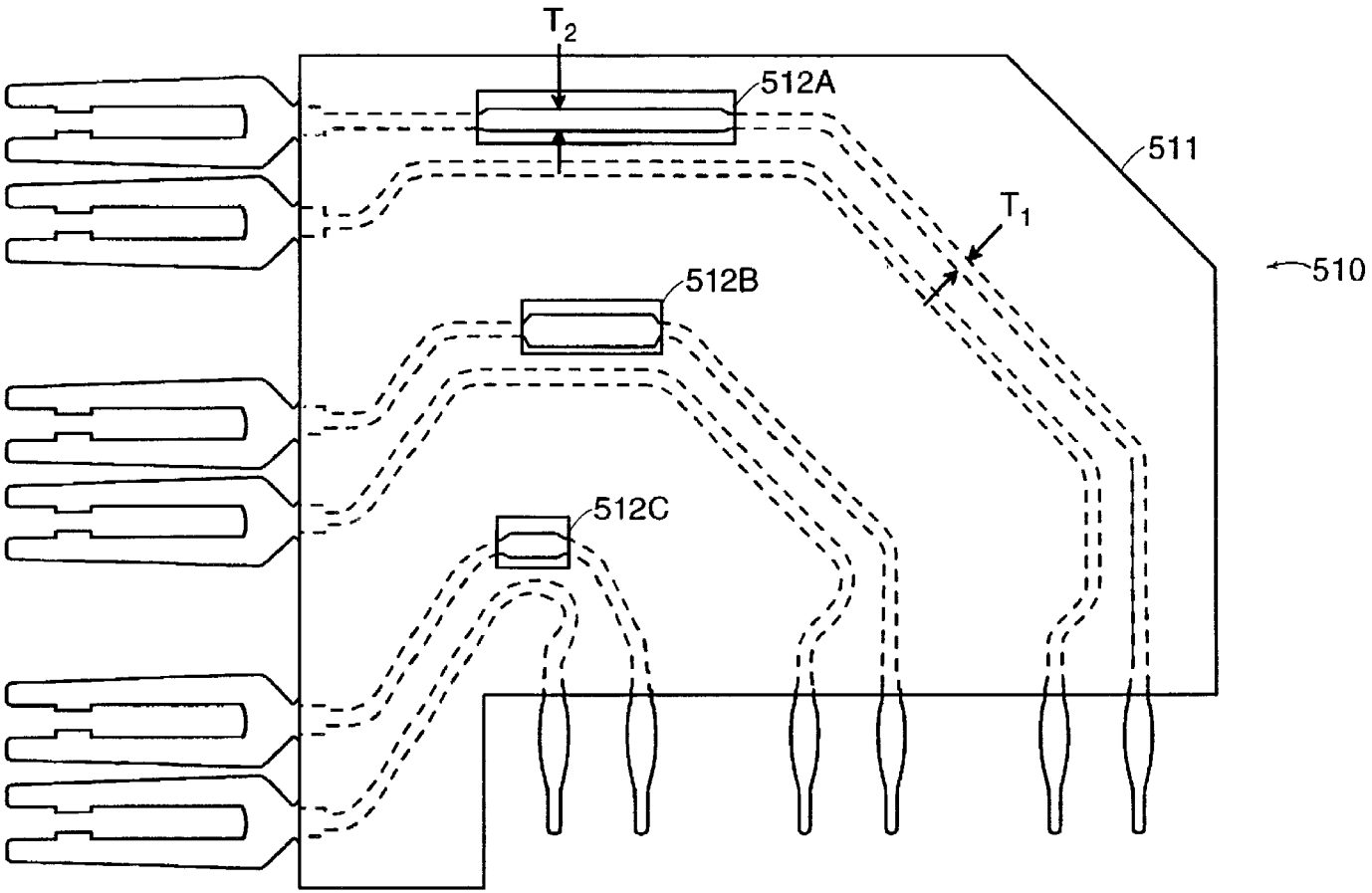
FIG. 10 is a schematic view of connector module with balanced electrical properties.

FIG. 10 shows an alternative embodiment for a differential connector module 510. As described above, a lead frame containing signal contacts is formed into a module by molding plastic 511 around the interim portions of the lead frame. In the module of FIG. 10, windows 512A, 512B and 512C are left in the plastic above the long lead in each pair. These windows serve to equalize the delay for signals traveling in the leads of each pair. As is known, the speed at which a signal propagates in a conductor is proportional to the dielectric constant of the material surrounding the conductor. Because air has a different dielectric constant that plastic, leaving the windows above the long leads, makes the signals in those leads move faster. As a result, the time for a signal to pass through the long lead and the short lead of the pair can be equalized.

The length of each window 512A . . . 512C depends on the differential length between the long leg and the short leg of the pair. Thus, the size of the window could be different for each pair. Also, it is possible that multiple windows might be included for a pair. Further, it is not necessary that the window be filled with air. The window could be formed with a material having a different dielectric constant than the rest of plastic 511. For example, a plastic with a low dielectric constant could be molded over portions of the long contacts in each pair in the window regions. Then, a plastic with a higher dielectric constant could be over molded to form the plastic housing 511. Also, it is not necessary that the "window" extend all the way to the surface of the conducting signal contact. The "window" could be partially filled with plastic and partially filled with air, which would still have the effect of lowering the effective dielectric constant of the material above the long leg.

One drawback of placing a window in the dielectric material is that it also changes the impedance of the signal contact in the region below the window. Changes in impedance along a signal conductor are often undesirable because signal reflections occur at the discontinuities. To counter this problem, other adjustments can be made to keep the impedance constant along the length of the signal conductors. One way that the impedance can be kept constant is by changing the width of the signal conductors. In FIG. 10, the signal conductors are shown with a width of $T_1$ in one region and a broader width $T_2$ in the region of the windows. The exact dimensions are chosen to match the impedance based on the relative dielectric constant between the two regions. The technique of altering the width of the signal contacts in window regions is useful regardless of why the window is formed in the connector and is not limited to windows formed to equalize delay. For example, some prior art connectors use windows over substantial portions of all the signal contacts to increase impedance of all the signal contacts.

Figure 11B:
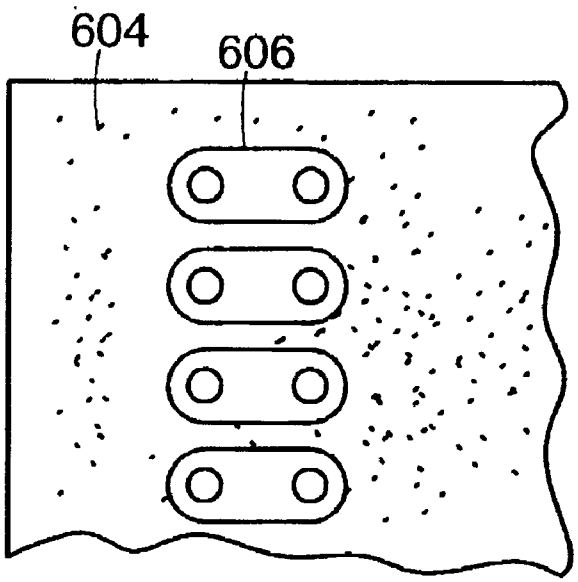
FIG. 11B is a sketch illustrating an improved circuit board signal launch.
Figure 11A:
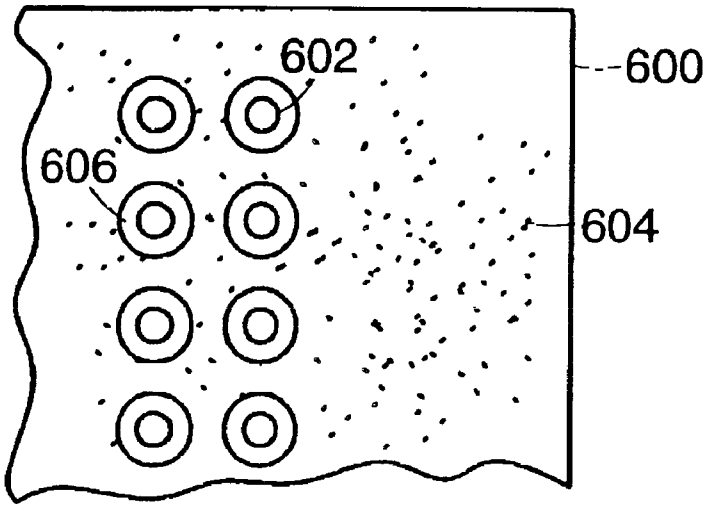
FIG. 11A (PRIOR ART)
FIG. 11A is a sketch illustrating a prior art circuit board signal launch.

FIGS. 11A and 11B show an alternative embodiment that can be used to increase the effectiveness of a differential connector. FIG. 11A illustrates a portion of a backplane 600 to which a connector might be attached. There are columns of holes 602 in backplane 600. The contact tails of the connector would be inserted into these holes to affix the connector to the backplane. One or more ground plane layers 604 are included within backplane 600. The ground plane layers are not deposited around the holes to avoid shorting out the connections made in the hole to leave exposed areas 606. However, in the prior art configuration shown in FIG. 11A, there is ground plane material deposited between the holes 602. FIG. 11B shows a backplane printed circuit board adapted for use with a differential connector. Ground plane layer 604 is deposited to leave an exposed area around the holes 602 that form a differential pair. In this way, there is no ground plane layer between the two holes of a differential pair. Consequently, the common mode coupling between the two conducting elements of the differential pair is improved.

Also, it should be appreciated that numbers and dimensions are given herein. Those numbers are for illustration only and are not to be construed as limitations on the invention. For example, connectors with 6 and 8 rows are illustrated. However, any number of rows could be conveniently made.

Also, it was described that shield plates could be used. Grounding members that are not plate shaped could also be used. The grounding members could be placed between pairs of conducting elements. In addition, the shields do not need to be planar. In particular, FIG. 3 and FIG. 4 illustrate a connector configuration in which there are spaces between differential pair. To increase the isolation between the differential pairs, tabs could be cut out of the shield plates and bent out of the plane of the plate to provide greater isolation between pairs.

It should also be recognized that the invention is illustrated by a right angle, press-fit, pin and socket connector. The invention is not useful simply in right angle applications. It could be used in stacking or mezzanine connectors. Nor is the invention limited to a press-fit connectors. It could be used with surface mount or pressure mount connectors. Moreover, the invention is not limited to just pin and socket style connectors. Various contact configurations are known and the invention could be employed with other contact configurations.

What is claimed is:

1. An electrical connector assembled from connector modules aligned in parallel, each connector module for transferring a plurality of differential signals between electrical components, each connector module comprising:

a plurality of pairs of signal conductors, each pair having a first signal path and a second signal path, each signal path having a pair of contact portions located at opposing ends of the signal path, and an interim section extending between the pair of contact portions; and wherein for each pair of signal conductors a first distance between the interim sections within a pair is less than a second distance between the interim section of one of said signal paths of the pair and the interim section of one of said signal paths of an adjacent pair of signal conductors.

2. The connector module of claim 1, wherein the interim section of each first signal path is aligned in a first plane, and the interim section of each second signal path is aligned in a second plane parallel to and spaced from the first plane.

3. The connector module of claim 1, wherein the interim section of each first signal path and the interim section of each second signal path are aligned in a plane.

4. The connector module of claim 1, wherein the connector is a right angle connector and the interim sections of each pair of signal conductors have equal electrical lengths.

5. The connector module of claim 1, wherein at least some of the paired signal paths are connected to a set of differential signals.

6. The connector module of claim 1, further comprising a plurality of shield plates, each shield plate in parallel with a module and spaced from the pairs of signal conductors, the shield plate providing a common ground signal path.

7. The connector module of claim 6, wherein the shield plate further comprises a main body and a tab, the tab extending from the main body and between at least two pairs of signal conductors.

8. The connector module of claim 6, wherein the shield plate further comprises a main body and a grounding contact portion extending from the main body.

9. The connector module of claim 8, wherein the grounding contact portion is adjacent to the contact portions of the signal paths.

10. The connector module of claim 8, wherein the grounding contact portion extends between the contact portions.

11. The connector module of claim 8, wherein the grounding contact portion extends between adjacent contact portions of two signal paths.

12. The connector module of claim 6, wherein the shield plate further comprises a main body and a resilient tab, the resilient tab having ends connected to the main body, and a center area of the resilient tab spaced away from the main body.

13. The connector module of claim 12, wherein the resilient tab has a curved shape between the ends.

14. The connector module of claim 6, further comprising an insulating member extending along a portion of the shield plate.

15. The connector module of claim 14, wherein the insulating member is a housing external to the shield plate and the plurality of signal conductors.

16. An electrical connector assembled form a plurality of modules aligned in parallel, each module for transferring a plurality of differential signals between electrical components, each connector module comprising:

a plurality of signal conductors, each signal conductor having a pair of contact portions located at opposing ends of the signal conductor, and an interim section extending between the contact portions;

wherein the intermediate portions of a first portion of the signal conductors are aligned in a plane and contain curved sections that route the intermediate section of each signal conductor in the first plurality toward to the intermediate section of a signal conductor in a second plurality of signal conductors, thereby forming a plurality of pairs of signal conductors within each module;

wherein for each pair of signal conductors a first distance between the interim sections within a pair is less than a second distance between the pair of signal conductors and any other pair of signal conductors of the plurality.

17. The electrical connector of claim 16 wherein one half of the contact portions extend from a first edge of the module in a first line and a second half of the contact portions extend from a second edge of the module in a second line.

18. The electrical connector of claim 17 wherein the contact portions in the first line have a uniform pitch.

19. An electrical connector assembled from a plurality of modules aligned in parallel, each module comprising:

a) an insulative housing;

b) a plurality of signal contacts having intermediate portions within the housing, mating contact portions extending from a first edge of the housing and contact tails extending from a second edge of the housing;

c) wherein the intermediate portions of alternating ones of the intermediate portions contain bend towards an adjacent signal conductor whereby the signal conductors are disposed in pairs with spacing between the intermediate portions of signal conductors in a pair less than the spacing between the intermediate portions of signal conductors in adjacent pairs.

20. The electrical connector of claim 19 wherein the contact tail portions are on a uniform pitch.

* * * * *